US009604470B2

(12) United States Patent
Kondo

(10) Patent No.: US 9,604,470 B2
(45) Date of Patent: Mar. 28, 2017

(54) SHEET DECURLING DEVICE AND INK-JET TYPE IMAGE FORMING APPARATUS INCLUDING THIS

(71) Applicant: KYOCERA Document Solutions Inc., Osaka (JP)

(72) Inventor: Kazuhisa Kondo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/162,676

(22) Filed: May 24, 2016

(65) Prior Publication Data

US 2016/0355029 A1 Dec. 8, 2016

(30) Foreign Application Priority Data

Jun. 5, 2015 (JP) ..... 2015-114706

(51) Int. Cl.
*B41J 11/00* (2006.01)
*B41J 2/01* (2006.01)

(52) U.S. Cl.
CPC ..... *B41J 11/0005* (2013.01); *B41J 2/01* (2013.01)

(58) Field of Classification Search
CPC ... B41J 11/0005; G03G 15/6576; B65H 22/34
See application file for complete search history.

(56) References Cited

U.S. PATENT DOCUMENTS

2005/0018029 A1* 1/2005 Takagi ..... B41J 15/048 347/104
2009/0003912 A1* 1/2009 Nagasaki ..... G03G 15/6576 399/406
2009/0167833 A1* 7/2009 Mochizuki ..... B41J 3/4078 347/104

FOREIGN PATENT DOCUMENTS

JP 2014-043325 A 3/2014

* cited by examiner

*Primary Examiner* — Geoffrey Mruk
*Assistant Examiner* — Scott A Richmond
(74) *Attorney, Agent, or Firm* — Studebaker & Brackett PC

(57) ABSTRACT

A sheet decurling device includes a decurling conveyance part and a nip forming part. The decurling conveyance part includes a plurality of first rollers provided axially rotatably and a first belt wrapped around the first rollers. The nip forming part forms a nip part nipping and conveying a sheet with the first belt. The nip forming part includes a plurality of decurling rollers whose curvatures of outer circumferential surfaces are different from each other and a change-over mechanism. The change-over mechanism supports the plurality of de curling rollers axially rotatably and selectively changes over the decurling roller to be brought into pressure contact with the first belt.

8 Claims, 7 Drawing Sheets

SHEET DECURLING DEVICE AND INK-JET TYPE IMAGE FORMING APPARATUS INCLUDING THIS

INCORPORATION BY REFERENCE

This application is based on and claims the benefit of priority from Japanese Patent application No. 2015-114706 filed on Jun. 5, 2015, the entire contents of which are incorporated herein by reference.

BACKGROUND

The present disclosure relates to a sheet decurling device and an ink-jet type image forming apparatus including this.

An ink-jet type image forming apparatus normally includes a sheet decurling device decurling a curled sheet. For instance, there is widely known a roller type sheet decurling device including a hard roller that comes into pressure contact with an elastic roller. However, the roller type sheet decurling device has a problem that it is difficult to assure a large (long) nip width, i.e., a distance in a sheet conveyance direction of the nip part.

Technologies solving the abovementioned problem are being proposed. For instance, a decurler (sheet decurling device) includes a belt wrapped around a plurality of rollers, instead of the elastic roller, and a hard roller. This belt type sheet decurling device can assure a large nip width because the belt is brought into pressure contact with the hard roller so as to be wrapped around the hard roller.

By the way, the decurler described above permits to change a decurling force applied on a sheet by increasing/decreasing an amount of the belt wrapped around the hard roller. However, if the amount of the belt wrapped around the hard roller decreases, a pressure applied by the hard roller to the belt also decreases. Then, because a sheet nipping force at the nip part drops, there is a case when the decurler is unable to adequately nip the sheet at the nip part. That is, there is a possibility of causing sheet conveyance failure, disabling to decurl the sheet. Meanwhile, if the amount of the belt wrapped around the hard roller increases, a pressure applied by the hard roller to the belt also increases. Therefore, there is a possibility of increasing a traveling load of the belt, while lowering a sheet conveyance speed.

SUMMARY

In accordance with an embodiment of the present disclosure, a sheet decurling device includes a decurling conveyance part and a nip forming part. The decurling conveyance part includes a plurality of first rollers provided axially rotatably and a first belt wrapped around the first rollers. The nip forming part forms a nip part nipping and conveying a sheet with the first belt. The nip forming part includes a plurality of decurling rollers whose curvatures of outer circumferential surfaces are different from each other and a change-over mechanism. The change-over mechanism supports the plurality of de curling rollers axially rotatably and selectively changes over the decurling roller to be brought into pressure contact with the first belt.

In accordance with an embodiment of the present disclosure, an ink-jet type image forming apparatus includes a sheet decurling device decurling a curled sheet. The sheet decurling device includes a decurling conveyance part and a nip forming part. The decurling conveyance part includes a plurality of first rollers provided axially rotatably and a first belt wrapped around the first rollers. The nip forming part forms a nip part nipping and conveying a sheet with the first belt. The nip forming part includes a plurality of decurling rollers whose curvatures of outer circumferential surfaces are different from each other and a change-over mechanism. The change-over mechanism supports the plurality of decurling rollers axially rotatably and selectively changes over the decurling roller to be brought into pressure contact with the first belt.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

A suitable embodiment of the present disclosure will be described below with reference to the attached drawings. It is noted that the following description will be made by defining a front side of sheet surfaces of FIG. 1 as a front view and based on directions indicated in each drawing. It is also noted that a term 'conveyance direction' indicates a conveyance direction of a sheet S and a 'width direction' indicates a width direction of the sheet S orthogonal to the conveyance direction. Still further, such terms as 'upstream' and 'downstream' in the following description represent 'upstream', 'downstream' or the like in a conveying direction of a sheet S.

Figure 1:
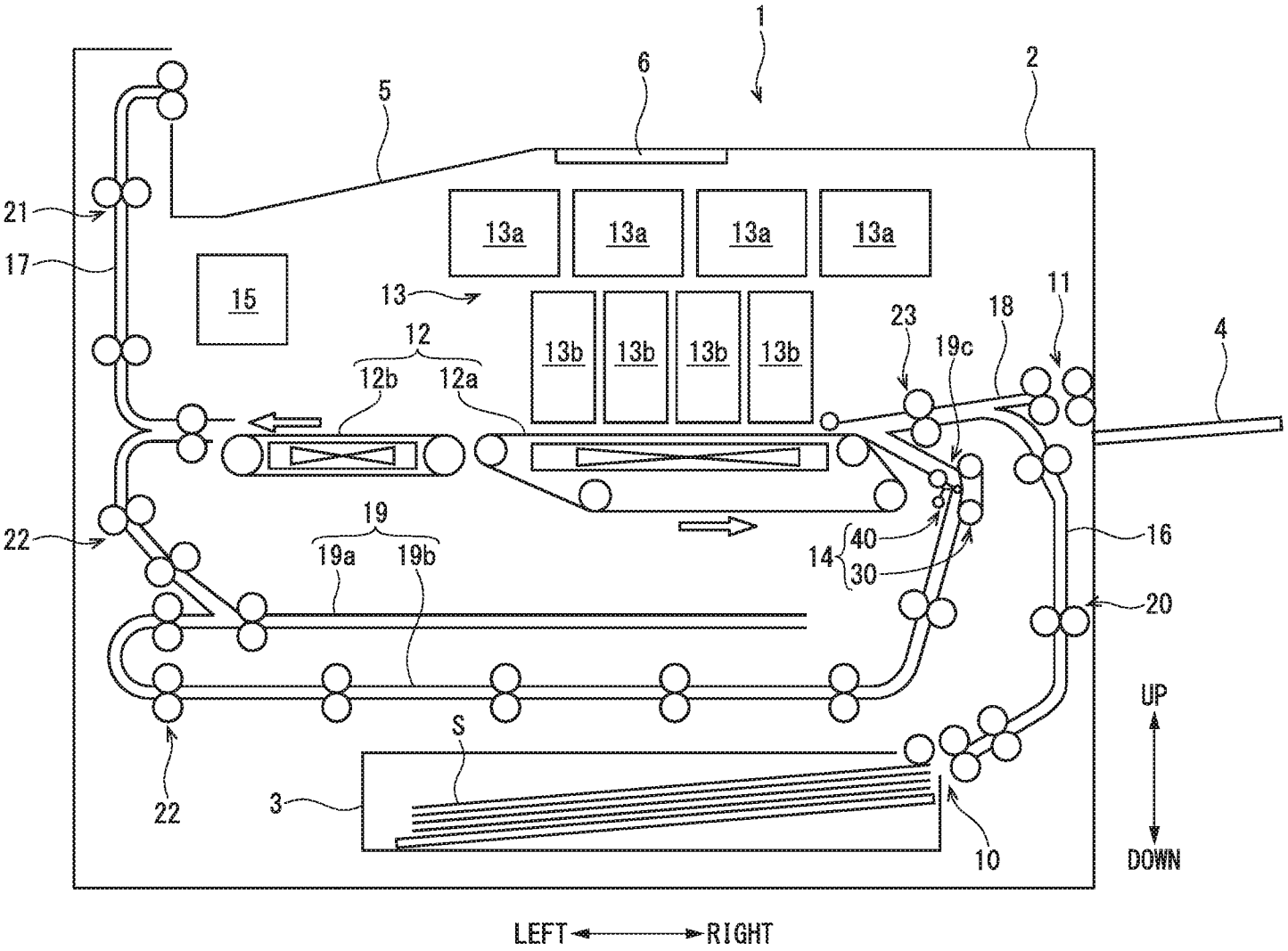
FIG. 1 is a sectional view schematically illustrating a printer according to a first embodiment of the present disclosure.

With reference to FIG. 1, a printer 1 as an ink-jet type image forming apparatus according to a first embodiment will be described. FIG. 1 is a sectional view schematically showing an inner structure of the printer 1.

The printer 1 includes an apparatus body 2, a sheet feed cassette 3, a manual tray 4, a sheet discharge tray 5 and a control panel 6. The apparatus body 2 is formed substantially into a shape of a box. The sheet feed cassette 3 is provided removably at a lower part of the apparatus body 2. The manual tray 4 extends in the right direction from a vertically intermediate part of a right side surface of the apparatus body 2. The sheet discharge tray 5 is provided at an upper part of the apparatus body 2. The control panel 6 is provided at an upper surface of the apparatus body 2.

A sheet S (bundle of the sheets S) is stored in the sheet feed cassette 3. The sheet S (bundle of the sheets S) is placed on an upper surface of the manual tray 4. It is noted that the sheet S is not limited to be a sheet of paper and may be a resin film, and the like.

The control panel 6 is manipulated by a user. The control panel 6 accepts inputs of printing conditions such as a type, a size, a basis weight of the sheet S to be used in printing, whether or not duplex printing is carried out, and whether or not magnification of an image is increased/decreased.

The printer 1 includes a cassette sheet feeding part 10, a manual sheet feeding part 11, a conveyance unit 12, a recording part 13, a sheet decurling device 14 and a controller 15 within the apparatus body 2. The apparatus body 2 also includes a first conveyance path 16, a second conveyance path 17, a manual conveyance path 18, and a reverse conveyance path 19, i.e., paths for conveying the sheet S.

The first conveyance path 16 is formed between the sheet feed cassette 3 and the conveyance unit 12, the second conveyance path 17 is formed between the conveyance unit 12 and the sheet discharge tray 5. The manual conveyance path 18 extends from the manual tray 4 and merges with a downstream end of the first conveyance path 16. The reverse conveyance path 19 is formed so as to communicate an upstream side of the second conveyance path 17 with the downstream end of the first conveyance path 16. The reverse conveyance path 19 is composed of a switch-back path 19*a* and a re-conveyance path 19*b*. The switch-back path 19*a* is bifurcated and turned down from the upstream end of the second conveyance path 17 and extends in the right direction. The re-conveyance path 19*b* is bifurcated and turned down from the switch-back path 19*a* and merges with the downstream end of the first conveyance path 16.

A plurality of first conveyance roller pairs 20 is disposed along the first conveyance path 16. In the same manner, a plurality of second conveyance roller pairs 21 is disposed along the second conveyance path 17, and a plurality of reverse conveyance roller pairs 22 is disposed along the reverse conveyance path 19. The respective conveyance roller pairs 20, 21, and 22 convey the sheet S by rotating while nipping the sheet S. A registration roller pair 23 temporarily blocking the sheet S to align a front edge of the sheet S is provided downstream of the first conveyance path 16. It is noted that the first conveyance path 16 and the plurality of first conveyance roller pairs 20 are one example of a 'main conveyance part' described in claims. Still further, the reverse conveyance path 19 and the plurality of reverse conveyance roller pairs 22 are one example of a 'reversing part' described in claims.

A cassette sheet feeding part 10 is provided at an upstream end of the first conveyance path 16. The cassette sheet feeding part 10 is configured to separate the sheet S within the sheet feed cassette 3 one by one and to deliver the sheet S to the first conveyance path 16. A manual sheet feeding part 11 is provided at an upstream end of the manual conveyance path 18. The manual sheet feeding part 11 is configured to separate the sheet S on the manual tray 4 one by one and to deliver the sheet S to the manual conveyance path 18.

The conveyance unit 12 is provided at a center part of the apparatus body 2. The conveyance unit 12 includes a first conveyance belt 12*a* and a second conveyance belt 12*b*. The respective conveyance belts 12*a* and 12*b* are wrapped around a plurality of rollers and are driven to travel in a direction of an arrow in FIG. 1. The second conveyance belt 12*b* is disposed downstream of the first conveyance belt 12*a*. It is noted that the respective conveyance belts 12*a* and 12*b* are provided with a large number of suction holes not shown. Then, a suction force acts on an upper surface of the respective conveyance belts 12*a* and 12*b* by driving a suction device not shown.

The recording part 13 includes four ink tanks 13*a* and four ink-jet heads 13*b*. The four ink tanks 13*a* are arrayed in a left-right direction under the sheet discharge tray 5. The four ink tanks 13*a* store four color (yellow, magenta, cyan, and black) inks (liquid), respectively. The four ink-jet heads 13*b* are arrayed in the left-right direction so as to face the upper surface of the first conveyance belt 12*a*. The ink-jet heads 13*b* are provided corresponding to the respective color inks. The respective ink-jet heads 13*b* include a large number of nozzles (not shown) discharging the inks onto the sheet S conveyed and held on the first conveyance belt 12*a*.

The sheet decurling device 14 is disposed downstream (in a vicinity of a part merging with the first conveyance path 16) of the reverse conveyance path 19 (the re-conveyance path 19*b*). The controller 15 is provided to control the respective components of the printer 1 such as the sheet decurling device 14. It is noted the sheet decurling device 14 and the controller 15 will be described in detail later.

Here, an operation of the printer 1 will be briefly described. The controller 15 executes an image forming process as follows based on image data inputted.

The cassette sheet feeding part 10 delivers the sheet S within the sheet feed cassette 3 to the first conveyance path 16, and the respective first conveyance roller pairs 20 convey the sheet S toward the recording part 13. The sheet S passes through the first conveyance path 16 and arrives at the registration roller pair 23. After correcting a skew of the sheet S, the registration roller pair 23 feeds the sheet S to the first conveyance belt 12*a* by synchronizing with ink discharge operations of the respective ink-jet heads 13*b*. The respective ink-jet heads 13*b* are controlled by the controller 15 based on image data and discharge the inks toward one surface (surface) of the sheet S being held and conveyed on the first conveyance belt 12*a*. Thereby, an ink image is formed on the sheet S.

The sheet S on which the image has been formed is fed from the first conveyance belt 12*a* through the second conveyance path 17 to the second conveyance belt 12*b*. In a case when no duplex printing is performed (one-face printing), the sheet S is discharged from the second conveyance path 17 to the sheet discharge tray 5. Meanwhile, if the duplex printing is to be performed, the sheet S is fed to the switch-back path 19*a* bifurcated from the second conveyance path 17 to reverse its surface and is then fed to the re-conveyance path 19*b*. The respective reverse conveyance roller pairs 22 reverse the sheet S on which the image has been formed and convey again toward the recording part 13 (on the first conveyance belt 12*a*). The respective ink-jet heads 13*b* form an ink image on another surface (back surface) of the sheet S. It is noted that the ink discharged onto the sheet S is almost dried during when the sheet S passes through the second conveyance belt 12*b*.

By the way, aqueous ink is more often used in the ink-jet type printer 1. The aqueous ink contains about 40 to 60% of water. If a paper-made sheet S absorbs the water, hydrogen bond of cellulose is separated and the sheet S expands. Due to that, the sheet S is curled (curved) such that an ink impact surface (image forming surface) side of the sheet S projects. For instance, in a case when an A4 size sheet S (67 g/m$^2$ of basis weight) is printed (an image is formed) with a printing rate of 100%, a curl whose radius of curvature is about 20 mm is generated. In a case of A4 size sheet S whose basis weight is different (300 g/m$^2$ of basis weight and printing rate of 100%), a radius of curvature of a curl thereof is about 200 mm. It is noted that the lower the printing rate, the smaller the curl amount (curvature) is (the larger the radius of curvature is). Then, the printer 1 of the first embodiment includes the sheet decurling device 14 removing the curl of the sheet S.

Figure 2:
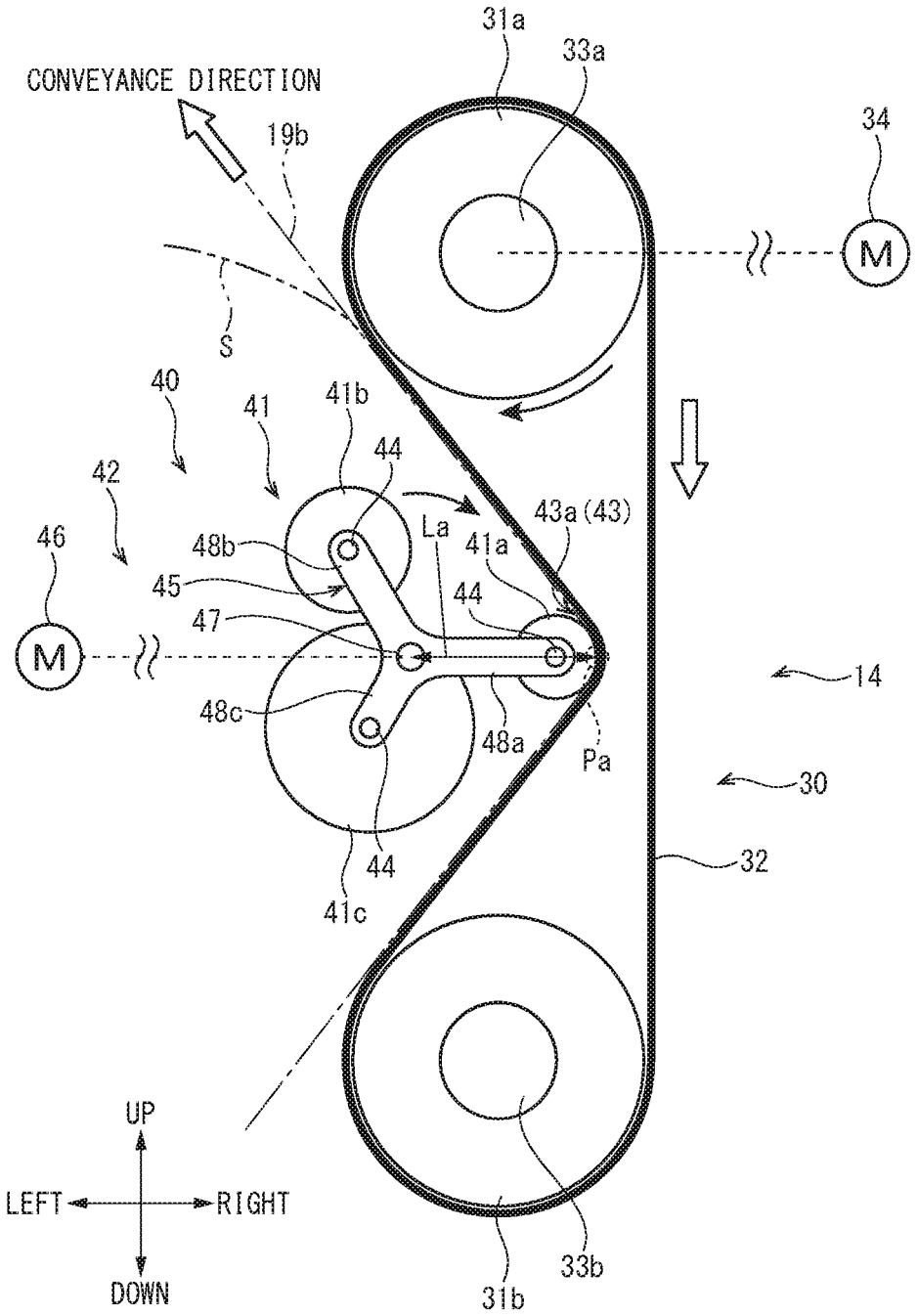
FIG. 2 is a front view illustrating a sheet decurling device of the first embodiment of the present disclosure in a state in which a small-diameter decurling roller is selected.
Figure 3:
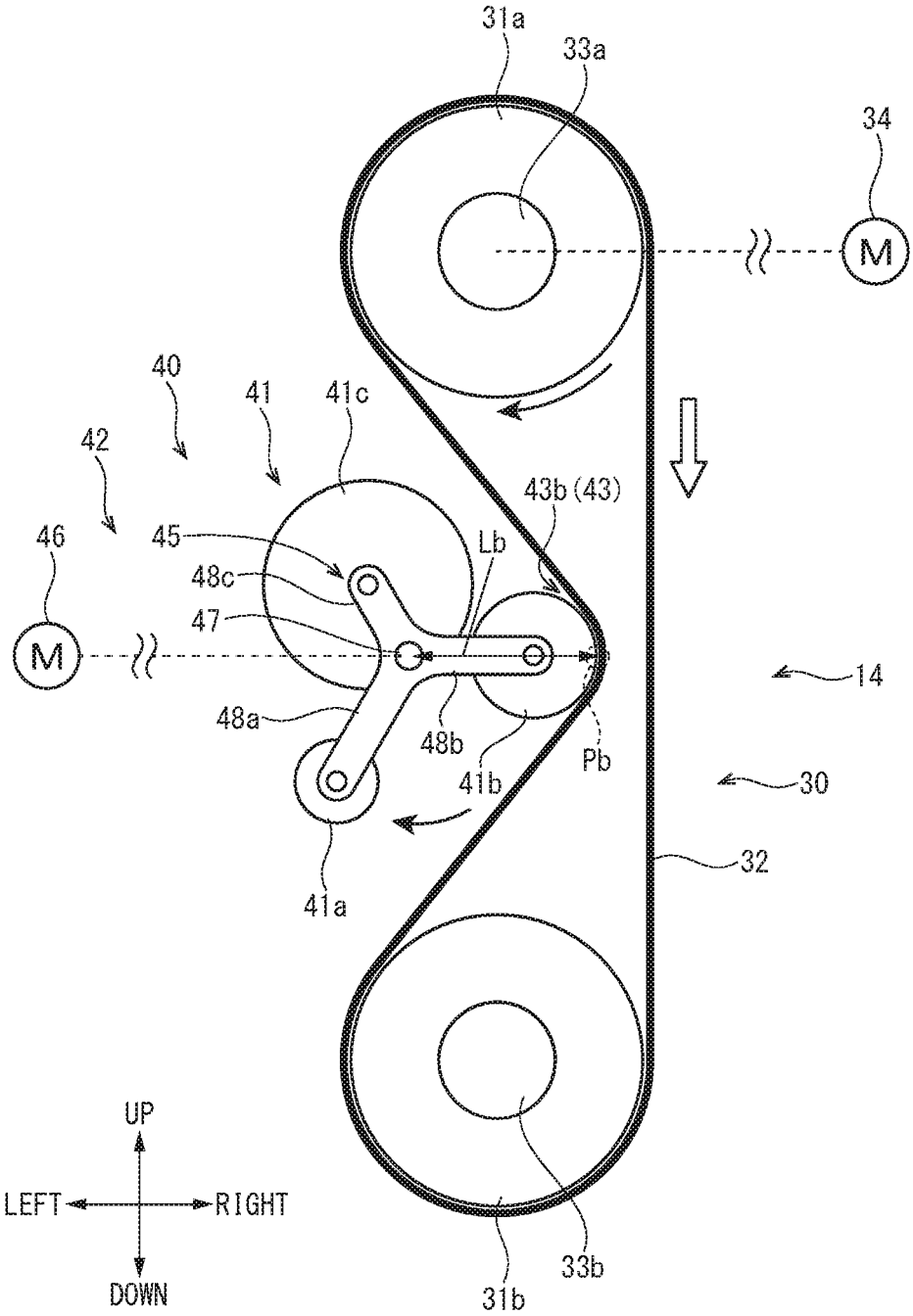
FIG. 3 is a front view illustrating the sheet decurling device of the first embodiment of the present disclosure in a state in which an intermediate-diameter decurling roller is selected.
Figure 4:
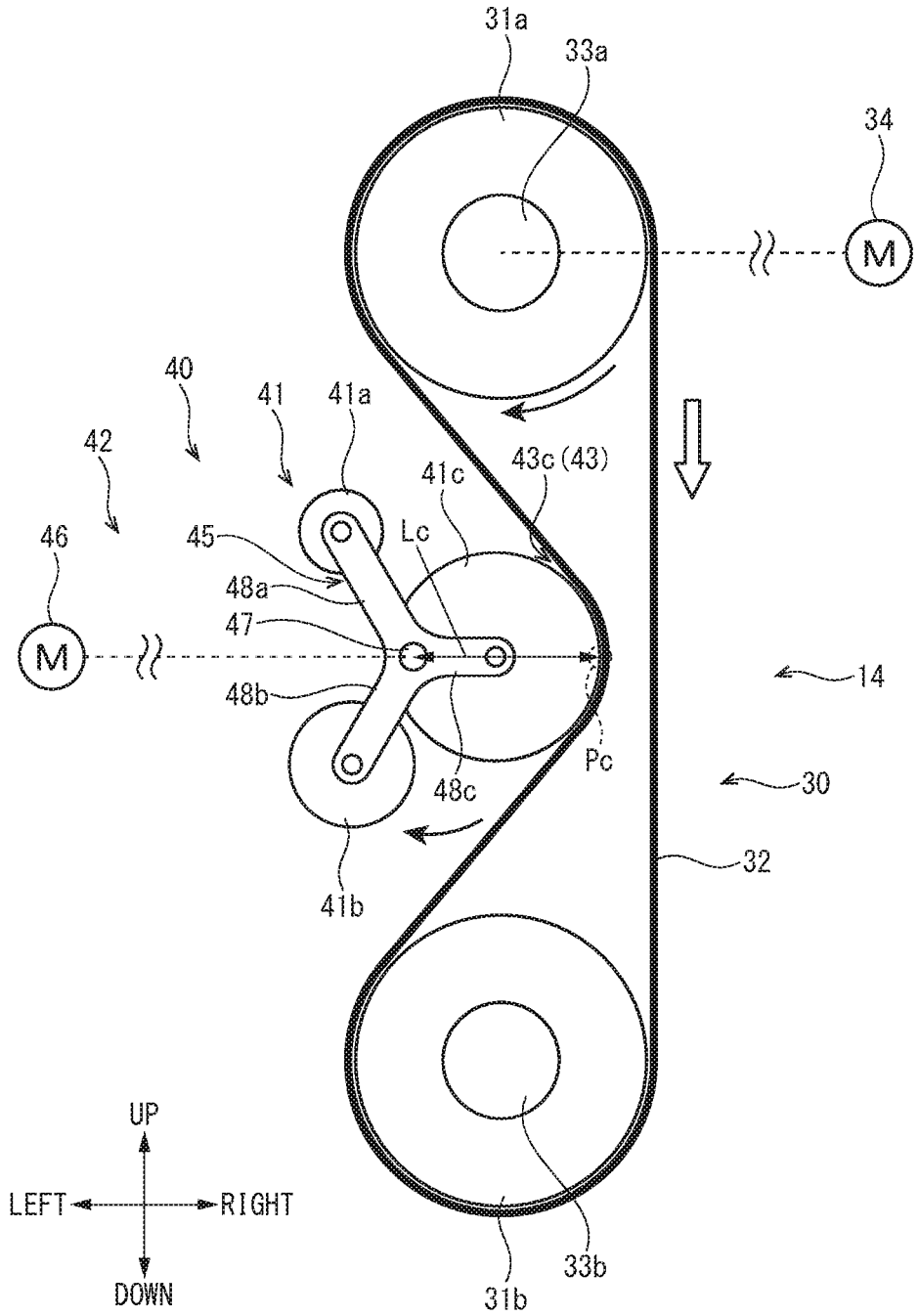
FIG. 4 is a front view illustrating the sheet decurling device of the first embodiment of the present disclosure in a state in which a large-diameter decurling roller is selected.

With reference to FIGS. 2 through 4, the sheet decurling device 14 will be described. FIG. 2 is a front view illustrating the sheet decurling device 14 in a state in which a small-diameter decurling roller 41*a* is selected. FIG. 3 is a front view illustrating the sheet decurling device 14 in a state in which an intermediate-diameter de curling roller 41*b* is selected. FIG. 4 is a front view illustrating the sheet decurling device 14 in a state in which a large-diameter decurling roller 41*c* is selected.

The sheet de curling device 14 includes a plurality of decurling conveyance parts 30 and a plurality of nip forming parts 40. While not shown, the plurality of decurling conveyance parts 30 and the plurality of nip forming parts 40 are arrayed in parallel at intervals in a width direction (front-back direction). It is noted that because the decurling conveyance parts 30 are constructed almost in the same manner, the following description will be made by noticing only on one decurling conveyance part 30. In the same manner, the following description will be made by noticing only on one nip forming portion 40.

As shown in FIG. 1, the decurling conveyance part 30 is disposed outside (on the right side) of a bent part 19*c* formed downstream of the re-conveyance path 19*b*. The nip forming part 40 is disposed so as to face the decurling conveyance part 30 from an inside (the left side) of the bent part 19*c*.

As shown in FIG. 2, the decurling conveyance part 30 is constructed by wrapping a first belt 32 around two first rollers 31*a* and 31*b* provided axially rotatably.

The two first rollers 31*a* and 31*b* are formed respectively into a cylindrical shape and are disposed separately in the vertical direction. The upper first roller 31*a* is fixed to a driving shaft 33*a* extending in the width direction (the front-back direction). The lower first roller 31*b* is fixed to a driven shaft 33*b* extending also in the width direction. The driving shaft 33*a* and the driven shaft 33*b* are supported axially rotatably with respect to the apparatus body 2. The driving shaft 33*a* is linked with a driving motor 34 through a gear train and others not shown. That is, the upper first roller 31*a* is rotationally driven by the driving motor 34.

The first belt 32 is formed endlessly by a material having elasticity such as rubber. The first belt 32 is wrapped around the two first rollers 31*a* and 31*b* in a condition in which the first belt 32 slightly extends from its natural length. Thereby, a predetermined tensile force acts on the first belt 32. When the driving motor 34 rotationally drives the first roller 31*a*, the first belt 32 travels in a direction of an arrow in FIG. 2. It is noted that the lower first roller 31*b* rotates following the travel of the first belt 32.

The nip forming portion 40 includes three decurling rollers 41*a*, 41*b*, and 41*c* and a change-over mechanism 42. The three decurling rollers 41*a*, 41*b*, and 41*c* have outer circumferential surfaces whose curvatures are different from each other. The change-over mechanism 42 supports the three de curling rollers 41*a*, 41*b*, and 41*c* axially rotatably. It is noted that the decurling roller will be denoted only by its reference numeral below in descriptions common to the three decurling rollers 41*a*, 41*b*, and 41*c*.

The respective decurling rollers 41 are made of metal such as stainless steel and are formed into a cylindrical shape, respectively. The respective decurling rollers 41 are disposed in parallel with the respective first rollers 31*a* and 31*b*. The three decurling rollers 41*a*, 41*b*, and 41*c* have diameters different from each other. For instance, the diameter of the decurling roller 41*a* is set at 8 mm (curvature: 250/m), the diameter of the decurling roller 41*b* is set at 12 mm (curvature: about 167/m). Still further, the diameter of the decurling roller 41*c* is set at 20 mm (curvature: 100/m).

The respective decurling rollers 41 press the first belt 32 and elastically deform the first belt 32. As shown in FIGS. 2 through 4, the respective decurling rollers 41*a*, 41*b*, and 41*c* form nip parts 43*a*, 43*b*, and 43*c* nipping and conveying the sheet S with the first belt 32 within the re-conveyance path 19*b*. The respective nip parts 43*a*, 43*b*, and 43*c* have shapes curved along the circumferential surface of the respectively decurling rollers 41*a*, 41*b*, and 41*c*. It is noted that the nip part will be denoted only by its reference numeral below in descriptions common to the three nip parts 43*a*, 43*b*, and 43*c*.

As shown in FIG. 2, the change-over mechanism 42 includes a frame 45 and a change-over motor 46.

The frame 45 is fixed to the change-over shaft 47 extending in the width direction. The change-over shaft 47 is disposed in parallel with the respective first rollers 31*a* and 31*b*. The change-over shaft 47 is supported axially rotatably with respect to the apparatus body 2. The frame 45 includes three arms 48*a*, 48*b*, and 48*c* whose lengths are different from each other. The three arms 48*a*, 48*b*, and 48*c* extend radially from the change-over shaft 47 in different directions. It is noted that the arm will be denoted only by the reference numeral below in descriptions common to the three arms 48*a*, 48*b*, and 48*c*.

The decurling rollers 41 are connected at a distal end of the respective arms 48*a*, 48*b*, and 48*c* so as to be rotatable centering on the rotation shaft 44. More specifically, the longest arm 48*a* pivotally supports the smallest decurling roller 41*a*, and the shortest arm 48*c* pivotally supports the largest decurling roller 41*c*. Still further, the arm 48*b* of an intermediate length pivotaly supports the decurling roller 41*b* having an intermediate diameter. That is, the diameters of the decurling rollers 41 are inversely proportional to the lengths of the arms 48. Still further, as shown in FIGS. 2 through 4, the three decurling rollers 41*a*, 41*b*, and 41*c* are disposed at positions where distances La, Lb, and Lc connecting contact points Pa, Pb, and Pc with the first belt 32 and the change-over shaft 47 is constant, i.e., La=Lb=Lc.

The change-over motor 46, i.e., the driving part, is a stepping motor for example and is configured to be able to control a rotation angle of an output shaft not shown. The output shaft of the change-over motor 46 is linked with the change-over shaft 47 through a gear train and others not shown. The change-over motor 46 rotationally drives the frame 45 centering on the change-over shaft 47. The change-over mechanism 42 is configured so as to selectively change over the decurling roller 41 to be brought into pressure contact with the first belt 32 by rotating the frame 45. It is noted that the change-over motor 46 may be configured to rotate the frame 45 only in one direction or in normal and reverse directions.

Figure 5:
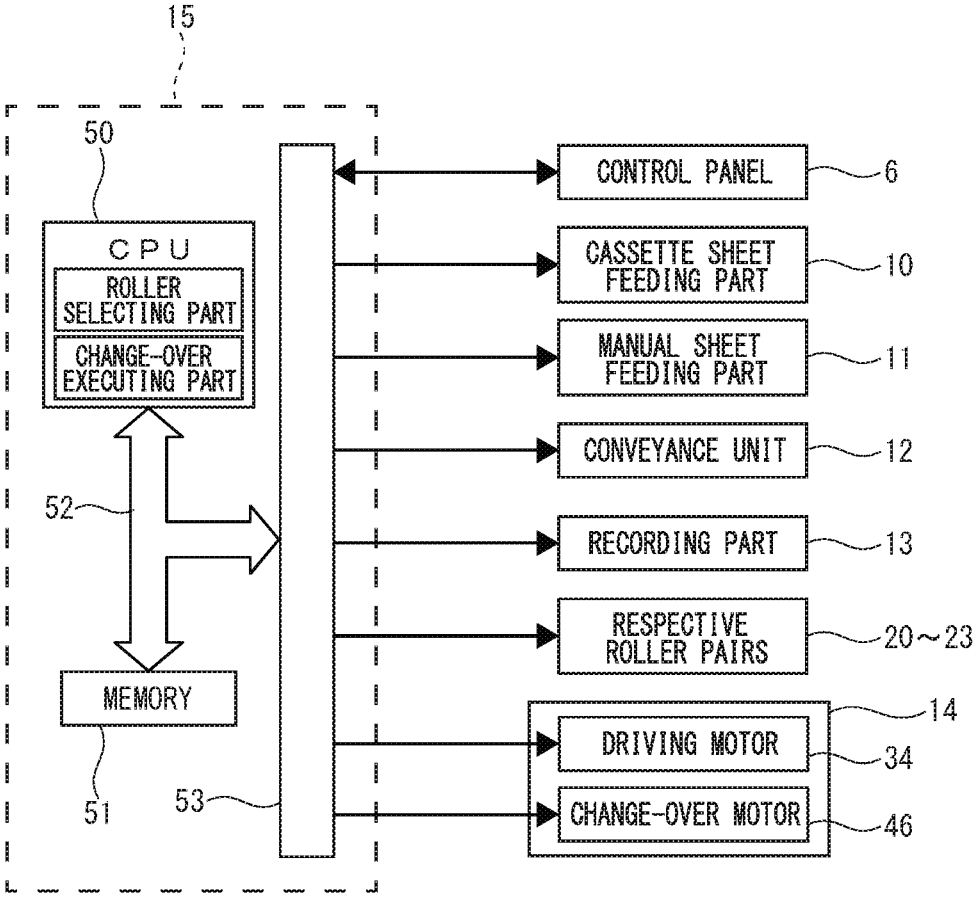
FIG. 5 is block diagram illustrating a controller and others of a printer of the first embodiment of the present disclosure.

With reference to FIG. 5, the controller 15 will be described. FIG. 5 is block diagram illustrating the controller 15 and others.

The controller 15 includes a CPU 50, a memory 51, a bus 52 and an interface 53. The CPU (Central Processing Unit) 50 executes various numerical calculations and controls the respective components of the printer 1. The memory 51 stores data, programs, and others required in the image forming process. The bus 52 electrically connects the CPU 50, the memory 51, and the interface 53. The interface 53 electrically connects the CPU 50 and others with the respective components of the printer 1.

The CPU 50 executes arithmetic operations in accordance to the data, programs, and others stored in the memory 51 to execute the image forming process by controlling the respective components of the printer 1. The CPU 50 accepts image data inputted from a computer not shown and connected with the printer 1 and information indicating printing conditions inputted through the control panel 6. The CPU 50 temporarily stores the received image data, the printing conditions, and others into the memory 51.

A table relating basis weight information, mode information, and information representing the three decurling rollers 41*a*, 41*b*, and 41*c* (such as diameters and curvatures) is stored in the memory 51. The control panel 6, the cassette sheet feeding part 10, the manual sheet feeding part 11, the conveyance unit 12, the recording part 13, the respective roller pairs 20 through 23, the driving motor 34 and the change-over motor 46 as well as the external computer and others are electrically connected with the interface 53. This arrangement makes it possible for the CPU 50 to exchange various control signals with the various components connected with the interface 53.

Next, a control of the sheet decurling device 14 made by the controller 15 will be described. At first, the user operates the control panel 6 and inputs the printing conditions. The printing conditions include the basis weight information indicating a basis weight of the sheet S, and the mode information indicating an one-face mode of forming an image on one surface of the sheet S or a duplex mod of forming images on both front and back surfaces of the sheet S. For instance, the user selects one basis weight information from the basis weight information set in eight stages within a range of 50 g/m$^2$ to 300 g/m$^2$.

The inputted printing conditions are temporarily stored in the memory 51. The CPU 50, i.e., a roller selecting part, selects the decurling roller 41 forming the nip part 43 among the three decurling rollers 41*a*, 41*b*, and 41*c* by making reference to the table stored in the memory 51 and based on the basis weight information and the mode information. The smaller the basis weight of the sheet S, the larger the curvature of the curl (radius of curvature is reduced) is as described above. Therefore, the table is prepared in advance so as to select the small-diameter decurling roller 41*a* in the case when the basis weight of the sheet S is small and so as to select the large-diameter decurling roller 41*c* in the case when the basis weight of the sheet S is large. That is, the condition is set in the table such that the basis weight of the sheet S is proportional to the diameter of the de curling roller 41.

For example, when the mode information is the duplex mode, the CPU 50 selects the decurling roller 41 as follows. When the basis weight information indicates a thin sheet S whose basis weight is around 50 g/m$^2$, the CPU 50 selects the decurling roller 41*a*. When the basis weight information indicates a thick sheet S whose basis weight is around 300 g/m$^2$, the CPU 50 selects the decurling roller 41*c*. When the basis weight information indicates a sheet S of an intermediate thickness, e.g., around 100 g/m$^2$, the CPU 50 selects the decurling roller 41*b*. It is noted that if the mode information indicates the one-face mode, the CPU 50 does not control the sheet decurling device 14.

Next, the CPU 50, i.e., a change-over executing part, causes the change-over mechanism 42 (the change-over motor 46) to execute a change-over control of changing over the selected decurling roller 41. That is, by being driven and controlled by the CPU 50, the change-over motor 46 rotates the frame 45 such that a selected decurling roller 41 comes into pressure contact with the first belt 32.

For instance, when the decurling roller 41*a* comes into pressure contact with the first belt 32 as shown in FIG. 2, a nip part 43*a* whose curvature is large is formed. Still further, when the decurling roller 41*c* comes into pressure contact with the first belt 32 as shown in FIG. 4, a nip part 43*c* whose curvature is small is formed. Still further, when the decurling roller 41*b* comes into pressure contact with the first belt 32 as shown in FIG. 3, a nip part 43*b* whose curvature is medium is formed.

Next, the CPU 50 controls the respective components of the printer 1 to execute the image forming process as described above. As described above, the sheet S on which the ink image has been formed on one surface thereof generates a predetermined curl. In the case when the duplex printing is to be performed, the sheet S on which the image has been printed on one surface thereof is reversed, is conveyed through the re-conveyance path 19*b* and arrives at the sheet decurling device 14. The curl which has been generated on the sheet S in the image forming process is removed in a process in which the sheet S passes through the nip part 43 of the sheet decurling device 14. More specifically, the sheet decurling device 14 decurls the sheet S such that the front edge of the sheet S is curved toward an opposite side (the first conveyance belt 12*a* side) of the respective ink-jet heads 13*b*.

For instance, the duplex printing is to be performed on the thin sheet (or on the sheet S of the intermediate thickness), the sheet S is decurled by passing through the nip part 43*a* (or the nip part 43*b*) as shown in FIG. 2 (or FIG. 3). However, because the thick sheet S is hardly curled, no strong decurling force is required. Therefore, in the case of performing the duplex printing on the thick sheet S, the sheet S is passed through the nip part 43*c* where the decurling force is weak (see FIG. 4).

The front edge of the sheet S which has passed through the nip part 43 and has been decurled is bent in the direction of the opposite side of the respective ink-jet heads 13*b* (the first conveyance belt 12*a* side). This arrangement makes it possible to prevent the front edge of the sheet S being re-conveyed to the recording part 13 from coming into contact with a nozzle forming surface of the ink-jet heads 13*b*.

According to the sheet decurling device 14 of the first embodiment described above, it is possible to change the curvature of the nip part 43 by selectively bringing the three decurling rollers 41 whose curvatures are different into pressure contact with the first belt 32. This arrangement makes it possible to change the decurling amount corresponding to the basis weight and others of the sheet S. Still further, even if the decurling roller 41 brought into pressure contact with the first belt 32 is changed, the pressure of the decurling roller 41 applied to the first belt 32 does not change considerably. This arrangement makes it possible for the nip part 43 to convey the sheet S while nipping the sheet S with adequate pressure.

Still further, according to the sheet decurling device 14 of the first embodiment, the distances La, Lb, and Lc connecting the contact points Pa, Pb, and Pc of the respective decurling rollers 41*a*, 41*b*, and 41*c* with the first belt 32 and the change-over shaft 47 is kept constant (approximately equal). Therefore, the respective decurling rollers 41*a*, 41*b*, and 41*c* can come into pressure contact with the first belt 32 with the constant (approximately equal) pressure. This arrangement makes it possible to keep a force nipping the sheet S at the nip part 43 constant even if the decurling roller 41 brought into pressure contact with the first belt 32 is changed.

Still further, the user can input the printing conditions (basis weight information and mode information) through the control panel 6. Because the decurling roller 41 is changed over based on the inputted printing conditions, a most suitable decurling operation corresponding to the printing conditions can be carried out.

Figure 6:
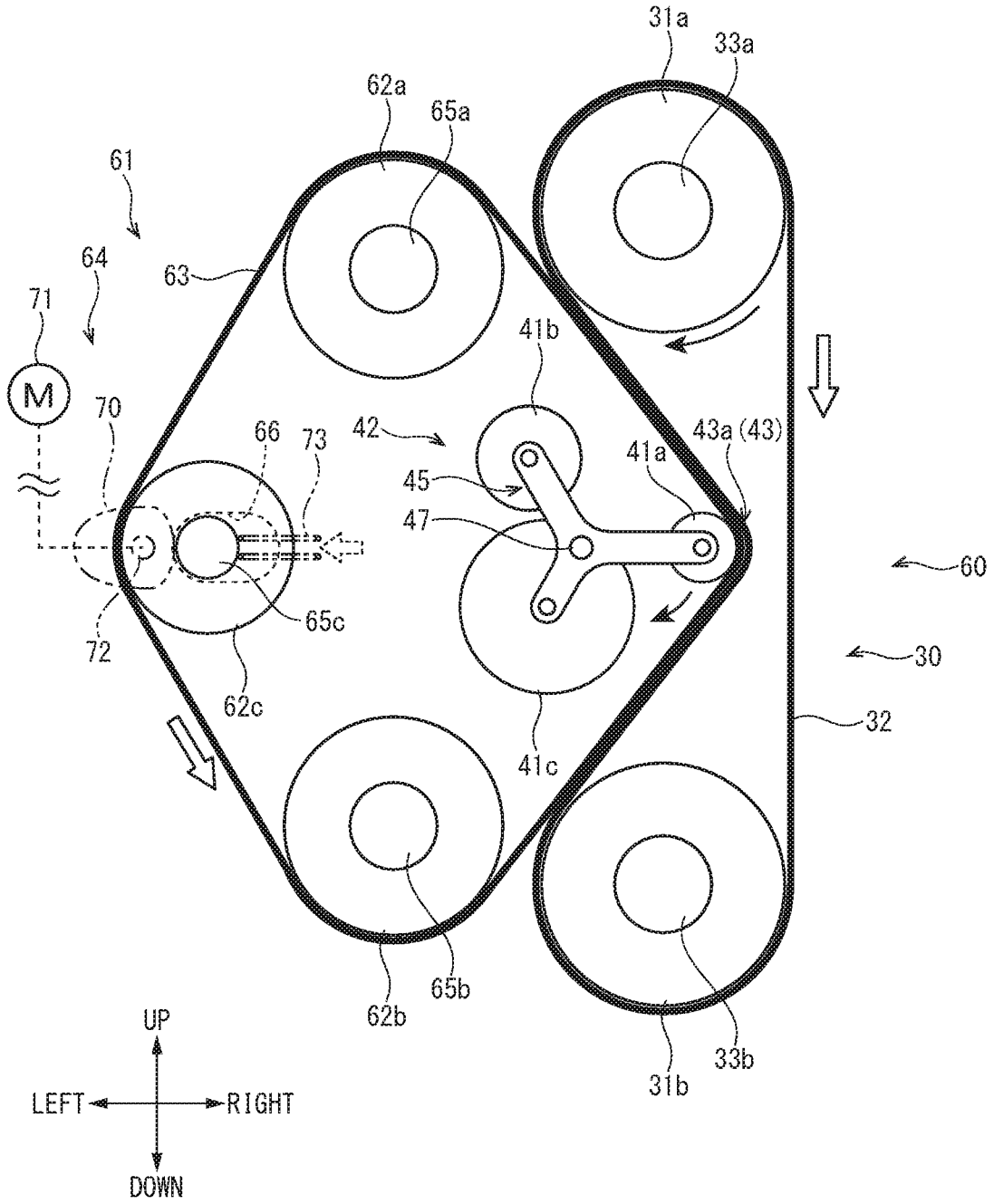
FIG. 6 is a front view illustrating a sheet decurling device of a second embodiment of the present disclosure in a state in which a small-diameter decurling roller is selected.
Figure 7:
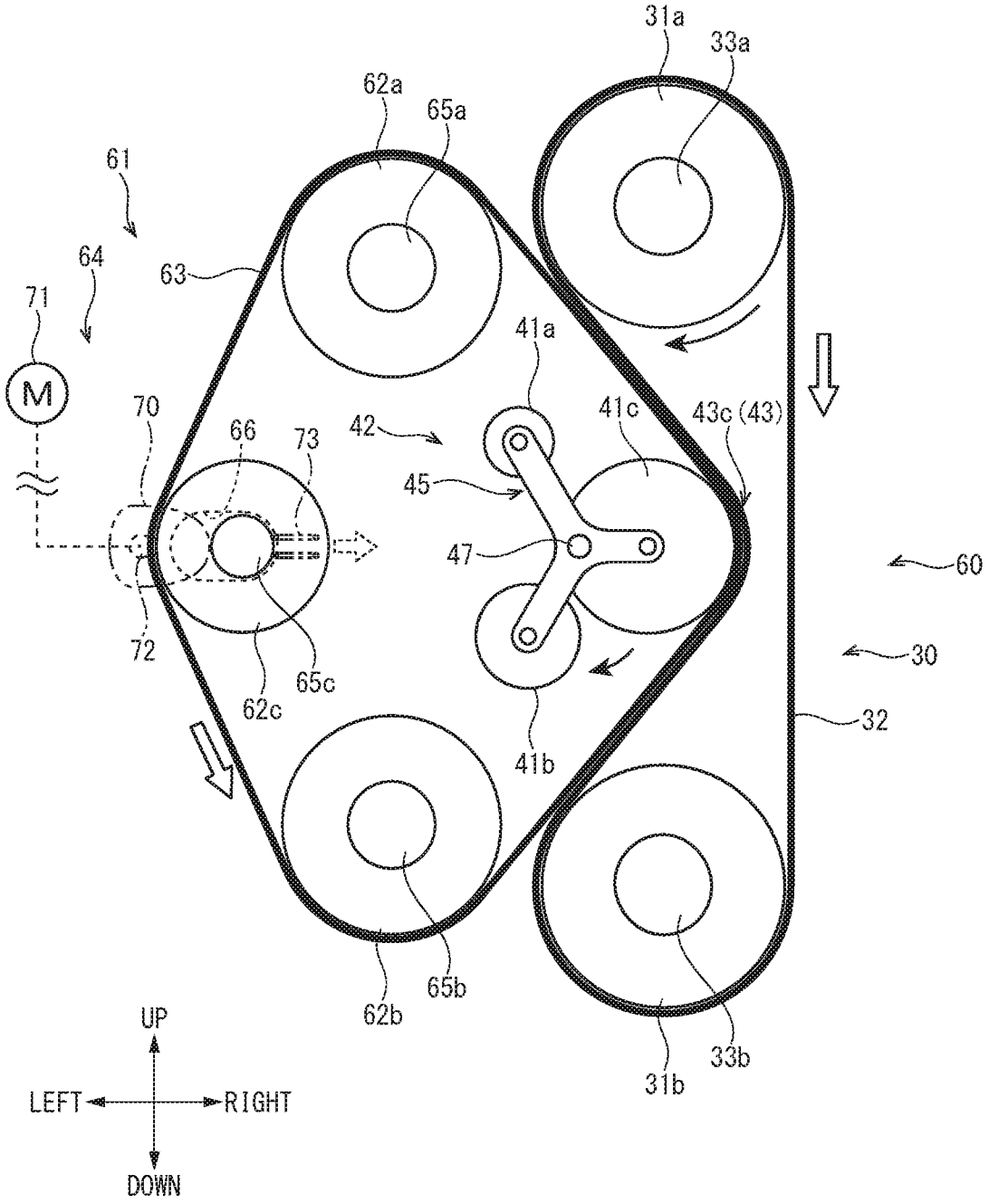
FIG. 7 is a front view illustrating the sheet decurling device of the second embodiment of the present disclosure in a state in which a large-diameter decurling roller is selected.

With reference to FIGS. 6 and 7, a sheet decurling device 60 according to a second embodiment will be described. FIG. 6 is a front view illustrating the sheet decurling device 60 in a state in which a small-diameter decurling roller 41*a* is selected. FIG. 7 is a front view illustrating the sheet decurling device 60 in a state in which a large-diameter decurling roller 41*c* is selected. It is noted that the same components with those of the sheet decurling device 14 described above will be denoted by the same or corresponding reference numerals and an explanation thereof will be omitted here.

As shown in FIG. 6, the sheet decurling device 60 includes a plurality of decurling conveyance parts 30 and a plurality of nip forming parts 61. While not shown, the plurality of decurling conveyance parts 30 and the plurality of nip forming parts 61 are arrayed at intervals in the width direction. It is noted that because the plurality of nip forming parts 61 has almost the same configuration, the following description will be made by noticing only on one nip forming part 61.

The nip forming part 61 includes three second rollers 62*a*, 62*b*, and 62*c*, a second belt 63, a roller moving part 64, three decurling rollers 41*a*, 41*b*, and 41*c*, and the change-over mechanism 42. It is noted that the second rollers will be denoted only by its reference numeral below in descriptions common to the three second rollers 62*a*, 62*b*, and 62*c*.

The three second rollers 62*a*, 62*b*, and 62*c* are formed into a cylindrical shape and are disposed separately in the vertical direction. The vertical pair of second rollers 62*a* and 62*b* is fixed respectively to second driven shafts 65*a* and 65*b* extending in the width direction. The second roller 62*c* (referred to also as a 'movable roller' 62*c* hereinafter) located at a vertically intermediate position is fixed to a movable shaft 65*c* extending in the width direction. The second driven shafts 65*a* and 65*b* and the movable shaft 65*c* are supported axially rotatably with respect to the apparatus body 2. That is, the respective second rollers 62 are provided axially rotatably.

Axial both ends of the movable shaft 65*c* engage slidably with guide grooves 66 formed on the apparatus body 2. The guide grooves 66 extend in the left-right direction. Thereby, the movable shaft 65*c* is supported movably in the left-right direction along the respective guide grooves 66.

The second belt 63 is formed endlessly by a material having elasticity such as rubber. The second belt 63 is wrapped around the three second rollers 62*a*, 62*b*, and 62*c* in a condition in which the second belt 63 extends slightly from its natural length.

The roller moving part 64 includes an eccentric cam 70 and a cam motor 71.

The eccentric cam 70 is supported rotatably centering on a cam shaft 72 extending in the width direction. An outer circumferential surface of the eccentric cam 70 composes a cam surface capable of coming into sliding contact with the movable shaft 65*c*. It is noted that the movable shaft 65*c* is biased toward the eccentric cam 70 by a biasing member 73 such as a coil spring.

The cam motor 71 is a stepping motor for example and an output shaft not shown thereof is linked with the cam shaft 72 through a gear train not shown. The cam motor 71 rotationally drives the eccentric cam 70 centering on the cam shaft 72. The movable roller 62*c* (the movable shaft 65*c*) moves in the left-right direction by an urging force of the biasing member 73 by rotating the eccentric cam 70. It is noted that while not shown, the cam motor 71 is electrically connected with the interface 53 of the controller 15.

The three decurling rollers 41 and the change-over mechanism 42 are disposed within the second belt 63 on a side of the first belt 32. The three decurling rollers 41*a*, 41*b*, and 41*c* are provided so as to come into pressure contact with the first belt 32 with the second belt 63 therebetween. The second belt 63 is brought into pressure contact with the first belt 32 by the decurling roller 41 and forms the nip part 43. Because the nip part 43 is formed between the first belt 32 and the second belt 63, a larger (longer) nip width (distance in the sheet conveyance direction at the nip part 43) can be assured. This arrangement makes it possible to increase (enhance) a decurling force applied to the sheet S.

Next, controls made on the sheet decurling device 60 performed by the controller 15 will be described. Based on the basis weight information and the mode information, the controller 15 (CPU 50) selects the decurling roller 41 and executes the change-over control. It is noted that because the controls made on the sheet decurling device 60 are the same with the controls made on the sheet decurling device 14 of the first embodiment, a detailed description thereof will be omitted.

Here, if the decurling roller 41 is changed over in a state in which the respective second rollers 62*a*, 62*b*, and 62*c* are fixed, a perimeter of the second belt 63 varies. For instance, if the decurling roller 41*a* in contact with the second belt 63 is changed over to the decurling roller 41*c*, the second belt 63 is stretched. Therefore, the perimeter of the second belt 63 extends and a tensile force acting on the second belt 63 increases. If the tensile force of the second belt 63 thus varies, the nipping force at the nip part 43 varies. Therefore, there is a possibility that it is unable to adequately convey or to decurl the sheet. Then, the roller moving part 64 of the sheet decurling device 60 moves the movable roller 62*c* so as to keep the perimeter of the second belt 63 constant when the change-over mechanism 42 changes over the decurling roller 41.

The roller moving part 64 moves the movable roller 62*c* (the movable shaft 65*c*) in a direction (the left-right direction) orthogonal to an axial direction. For instance, in the case of changing over from the decurling roller 41*a* to the decurling roller 41*c*, the CPU 50 controls the drive of the cam motor 71 to rotate the eccentric cam 70 in the state as shown in FIG. 6. Then, as shown in FIG. 7, the movable roller 62*c* (the movable shaft 65*c*) moves to the right side (in a direction of shortening the perimeter of the second belt 63) along the respective guide grooves 66 by resisting against the biasing force of the biasing member 73. In the same manner, in a case of changing over from the decurling roller 41*c* to the decurling roller 41*a*, the cam motor 71 rotates the eccentric cam 70 in the state as shown in FIG. 7. Then, as shown in FIG. 6, the movable roller 62*c* (the movable shaft 65*c*) is biased by the biasing member 73 and moves in the left side (a direction prolonging the perimeter of the second belt 63).

According to the sheet decurling device 60 of the second embodiment described above, it is possible to obtain the same effects as those of the sheet decurling device 14 of the first embodiment. Still further, when the decurling roller 41 is changed over, the roller moving part 64 moves the movable roller 62*c* to keep the perimeter of the second belt 63 constant. That is, the tensile force acting on the second belt 63 is kept constant. This arrangement makes it possible to keep the nipping force at the nip part 43 constant even if the decurling roller 41 being in pressure contact with the first belt 32 through the second belt 63 is changed over.

It is noted that while the roller moving part 64 of the sheet decurling device 60 of the second embodiment moves one second roller 62*c* among the three second rollers 62*a*, 62*b*, and 62*c*, the present disclosure is not limited to such configuration. The roller moving part 64 will do if it is configured to move at least one roller among the three second rollers 62*a*, 62*b*, and 62*c* in the direction orthogonal to the axial direction.

It is noted that while the roller moving part 64 of the sheet decurling device 60 of the second embodiment is composed of the cam mechanism, the present disclosure is not limited also to such configuration. For instance, a rack-and-pinion may be used instead of the eccentric cam 70.

It is noted that while the sheet decurling devices 14 and 60 of the first and second embodiments include the three decurling rollers 41, the present disclosure is not limited to such configuration. The present disclosure will do if the sheet decurling device includes two or more decurling rollers 41 having curvatures different from each other.

It is also noted that while the sheet decurling devices 14 and 60 of the first and second embodiments are disposed downstream of the reverse conveyance path 19 (the re-conveyance path 19*b*), the present disclosure is not also limited to such configuration. For instance, the sheet decurling device 14 may be disposed also along the second conveyance path 17 (downstream of the recording part 13) (see FIG. 1). In this case, when the one-face mode is to be done, the CPU 50 executes controls, i.e., the selection and change-over controls of the decurling roller 41, of the sheet decurling devices 14 and 60. Still further, in this case, the CPU 50 may select the decurling roller 41 based on at least one of the basis weight information and the mode information.

It is also noted that while the controller 15 of the printer 1 of the first and second embodiments controls the sheet decurling devices 14 and 60 based on the basis weight information and mode information, the present disclosure is not limited to such configuration. For instance, the controller 15 may control the sheet decurling devices 14 and 60 based on a type of the sheet S, e.g., a plain sheet, a gloss sheet or the like, a size, a printing rate, environmental conditions, e.g., temperature, humidity and others within and without of the apparatus body 2. Still further, while the printer 1 of the first and second embodiments is configured to input the basis weight information and mode information from the control panel 6, they may be inputted, instead, from a device driver of a computer for example.

While the preferable embodiment and its modified example of a sheet decurling device and an ink-jet type image forming apparatus including this of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. A sheet decurling device, comprising:

a decurling conveyance part including a plurality of first rollers axially rotatably provided and a first belt wrapped around the first rollers; and a nip forming part forming a nip part nipping and conveying a sheet with the first belt;

wherein the nip forming part including:

a plurality of decurling rollers whose curvatures of outer circumferential surfaces are different from each other; and a change-over mechanism configured to axially rotatably support the plurality of decurling rollers and configured to selectively change over the decurling roller to be brought into pressure contact with the first belt.

2. The sheet decurling device according to claim 1, wherein the change-over mechanism includes:

a frame configured to pivotally support the plurality of decurling rollers, and a driving part configured to rotate the frame centering on a change-over shaft, wherein the plurality of decurling rollers is disposed at positions where a distance connecting a contact point with the first belt and the change-over shaft is constant.

3. The sheet decurling device according to claim 1, wherein the nip forming part further includes:

a second belt wrapped around a plurality of second rollers axially rotatably provided and forming the nip part by coming into pressure contact with the first belt, and a roller moving part configured to move at least one of the plurality of second rollers in a direction orthogonal to an axial direction, wherein one of the plurality of decurling rollers come into pressure contact with the first belt with the second belt therebetween, and the roller moving part moves at least one of the second rollers to keep a perimeter of the second belt constant when the change-over mechanism changes over the decurling roller.

4. The sheet decurling device according to claim 3, wherein the roller moving part includes;

an eccentric cam including a cam surface capable of coming into sliding contact with a movable shaft supporting at least one of the second rollers;

a biasing member configured to bias the movable shaft toward the eccentric cam; and a cam motor configured to rotationally drive the eccentric cam centering on the cam shaft.

5. An ink-jet type image forming apparatus, comprising:

a sheet decurling device configured to decurl a curled sheet;

wherein the sheet decurling device including;

a decurling conveyance part including a plurality of first rollers axially rotatably provided and a first belt wrapped around the first rollers; and a nip forming part forming a nip part nipping and conveying a sheet with the first belt;

wherein the nip forming part including:

a plurality of decurling rollers whose curvatures of outer circumferential surfaces are different from each other; and a change-over mechanism configured to axially rotatably support the plurality of decurling rollers and configured to selectively change over the decurling roller to be brought into pressure contact with the first belt.

6. The ink-jet type image forming apparatus according to claim 5, further comprising:

a recording part including an ink-jet head discharging ink to one surface of the sheet to form an image;

a main conveyance part configured to convey the sheet toward the recording part;

a reversing part configured to reverse the sheet on which the image has been formed at the recording part to convey again toward the recording part; and a controller configured to control the sheet decurling device, wherein the controller including, a roller selecting part configured to select the decurling roller forming the nip part among the plurality of decurling rollers based on at least one of basis weight information indicating a basis weight of the sheet and mode information indicating an one-side mode of forming an image on one surface of the sheet and a duplex mode of forming images on both front and back surface of the sheet; and a change-over executing part of causing the change-over mechanism to execute the change-over control of changing over the decurling roller selected by the roller selecting part.

7. The ink-jet type image forming apparatus according to claim 6, wherein the controller includes a memory configured to store a table setting such that a basis weight of the sheet is proportional to a diameter of the decurling roller.

8. The ink-jet type image forming apparatus according to claim 6, wherein the reversing part includes:

a reverse conveyance path configured to convey the sheet; and a plurality of conveyance roller pairs disposed along the reverse conveyance path and conveying the sheet by rotating while nipping the sheet, wherein the sheet decurling device is disposed downstream in the sheet conveyance direction of the reverse conveyance path and bends a front edge of the sheet toward an opposite side of the ink-jet head.

* * * * *